US007559430B2

(12) United States Patent
D'Olimpio et al.

(10) Patent No.: US 7,559,430 B2
(45) Date of Patent: Jul. 14, 2009

(54) COLLAPSIBLE SERVING TRAY

(75) Inventors: Dominic M. D'Olimpio, Quincy, MA (US); Andrew W. Santin, Newton, MA (US)

(73) Assignee: Dominic D Olimpio, Quincy, MA (US)

( * ) Notice: Subject to any disclaimer, the term of this patent is extended or adjusted under 35 U.S.C. 154(b) by 661 days.

(21) Appl. No.: 11/263,006

(22) Filed: Oct. 31, 2005

(65) Prior Publication Data

US 2006/0049193 A1 Mar. 9, 2006

Related U.S. Application Data

(62) Division of application No. 10/282,355, filed on Oct. 29, 2002, now abandoned.

(51) Int. Cl.
*B65D 6/18* (2006.01)

(52) U.S. Cl. ..... 220/7; 220/6

(58) Field of Classification Search ..... None
See application file for complete search history.

(56) References Cited

U.S. PATENT DOCUMENTS 3,541,730 A * 11/1970 Ballantyne ..... 49/386
3,552,595 A * 1/1971 Gerner et al. ..... 220/4.23
4,678,095 A * 7/1987 Barnett et al. ..... 220/4.21
6,003,708 A 12/1999 Meyering

* cited by examiner

*Primary Examiner*—Stephen Castellano

(57) ABSTRACT

A collapsible serving tray that is stiff and flat when open and reduced in size and compact when folded. The tray is designed to be folded up into a compact size that is about one-quarter of the fully deployed size of the tray. One embodiment of the tray includes a perimeter edge that is ninety degrees to the flat serving surface when the tray is fully deployed.

4 Claims, 3 Drawing Sheets

COLLAPSIBLE SERVING TRAY

PRIORITY

This application is a divisional of and claims priority from U.S. patent application Ser. No. 10/282,355, filed Oct. 29, 2002 now abandoned.

BACKGROUND OF INVENTION

1. Field of Invention

The present invention relates to the service of food and beverages. In particular, it relates to trays upon which to deliver such items. It further relates to serving trays which can be deployed quickly and returned to storage quickly. More particularly, the invention relates to a sturdy serving tray capable of being reusably folded into a small manageable size that fits into a pocket or holster and then reversibly deployed into a rigid tray which can carry a plurality of, e.g., beverage containers. The invention further relates to a multi-folding mechanism that enables an assembly to be both flexible and stiff in its desired modes of use.

2. Background of the Invention

Serving trays have been used since time out of mind in food and beverage service to assist the server in the efficient delivery of food and beverages and removal of waste. Traditional trays are too large to carry in a pocket or apron and are difficult to store when servers need to write or use their hands in serving. The server needs a firm surface large enough to handle multiple items and then needs to be able to store the tray when not in use but still have the tray handy for future use.

Existing stiff trays are made in a variety of sizes and are generally easily stacked. They exhibit good stiffness in serving but not easy storing and carrying. Existing folding trays made of paper and cardboard exhibit good storage properties at minimum expense but do not prove sturdy enough in service or provide stiff enough service surfaces, especially for repeated use.

OBJECTS OF THE INVENTION

It is therefore an object of the invention to provide a rigid serving tray surface. It is another object of the invention to provide a rigid serving tray that can be folded into a much smaller configuration for storage. It is a further object of the invention to provide a foldable tray that can be deployed and returned to a storage configuration quickly and easily, preferably with one hand. It is yet another object of the invention to provide a tray that is aesthetically pleasing and that optionally provides advertising space on its surfaces.

SUMMARY OF THE INVENTION

In accordance with the present invention, there is provided a collapsible serving tray that is stiff and flat when open and reduced in size and compact when folded. In its most general form, the invention is a tray that is constructed of a plurality of main segments that are approximately equal in size. These segments are hinged to each other with preferably at least one joint being unhinged. In a preferred embodiment, the plural segments comprise four quadrants, two quadrants being connected by a hinge and thereby comprising a first subassembly, and two quadrants not hinged to one another but each hinged separately to the first subassembly.

The four quadrants are also attached to one another on the opposite side from the hinges by a flexible material, for example rubber or rubber-like silicone. The two quadrants that are unhinged are therefore attached to one another by the flexible material. In this embodiment, the position of the hinges and the number of joints allow the tray to fold down to the size of one quadrant that is four layers thick. This size enables a server to store the tray in a pocket or apron, or clip it to a belt, or tuck it into the small of the back. The flexible material is positioned and configured that it is stretched when the tray is folded into its storage configuration. Thus the flexible material pulls the quadrants into the flat unfolded position.

In another embodiment, when the invention is unfolded, the four quadrants have the outer corner removed so as to make, when the tray is unfolded, an octagonal shape that constitutes the serving surface. Attached to the outside edge of the perimeter portions of each of the quadrants are three smaller rectangular pieces, called edge portions, that hinge upward and reversibly lock together. The three edge portions per quadrant fold flat when in the folded state, that is, the storage position. The edge portions for all four quadrants also reversibly lock to the adjacent set of edge portions so as to form an assembly. The assembly in effect forms a rigid rim for the tray when it is unfolded. This rigid rim assembly gives the tray surface sufficient rigidity to function as a tray when the tray is fully deployed. The assembly additionally comprises a rim assembly mechanism that pulls the edge portions into the hinged position when the tray is deployed.

The mechanism that provides the stiffness of this embodiment of the tray is the function of the edge portions when they are hinged ninety degrees to the flat serving surface. These small edge portions when folded up and reversibly locked together produce a stiffening beam effect across the hinge areas of the four quadrants enabling the flexible joint of the fold to become stiff when the tray is open. The one unhinged joint of the quadrants needs to be locked when the tray is open. This is achieved by a locking mechanism to secure the walls bent ninety degrees and joined across the open quadrant. Other stiffening features include a tongue and groove detail in the edge of the quadrants that are not hinged. This feature improves the shear strength in the open position.

Two mechanisms that provide features for ease of opening and closing can be used in slightly different embodiments. In one embodiment, a spring-tensioned system is employed to connect the perimeter walls. This spring mechanism enables the side walls to move from being planner with the four quadrants to ninety degrees to the quadrants plane, in one simultaneous action. This action also engages a snap mechanism on the unhinged side which secures the tray's integrity. In another embodiment, the spring-tensioned system is replaced by a circumferential elastomeric loop that connects the perimeter walls. The second mechanism is the use of an elastomeric surface that provides the features of self opening the tray as well as maintaining a lateral force on the unhinged quadrant joints to preserve the stiffness across the joint.

In another embodiment of the invention, when the tray is unfolded, the four quadrants make a rectangular shape that constitutes the serving surface. In this embodiment, there are no vertical edges around the perimeter. The means for providing the stiffness of this embodiment of the tray are two-part latching mechanisms between the three quadrants that are hinged together. These two-part latching mechanisms not only maintain the base portion of the tray in a flat rigid condition, but also function as small legs to set the tray on.

BRIEF DESCRIPTION OF THE DRAWINGS

A complete understanding of the present invention may be obtained by reference to the accompanying drawings, considered in conjunction with the subsequent detailed description.

IDENTIFICATION OF ITEMS IN THE FIGURES

For purposed of clarity and brevity, like elements and components will bear the same designations and numbering throughout the FIGURES.

Figure 1A:
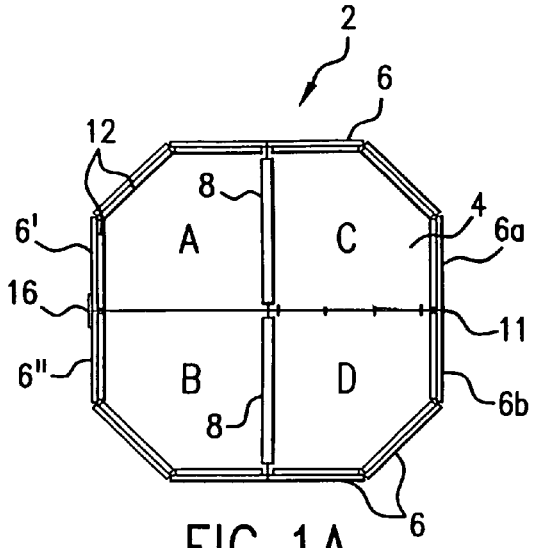
FIG. 1A is an orthogonal top view of a first embodiment of the fully deployed folding tray according to the present invention.
Figure 1C:
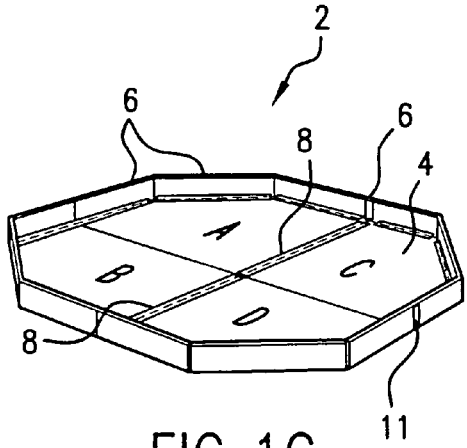
FIG. 1C is an oblique view of the first embodiment of the tray.
Figure 1B:
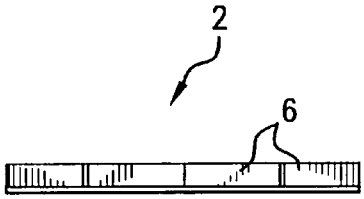
FIG. 1B is an orthogonal side view of the first embodiment of the folding tray according to the present invention.
Figure 2A:
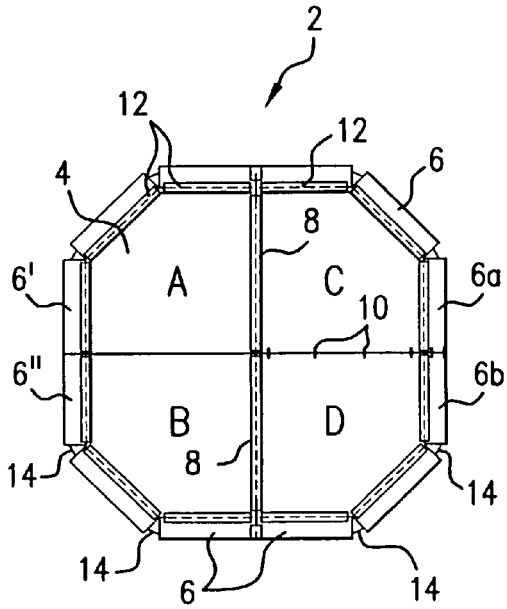
FIG. 2A is an orthogonal top view of the first embodiment with the edges folded into the plane of the base portion.
Figure 2B:
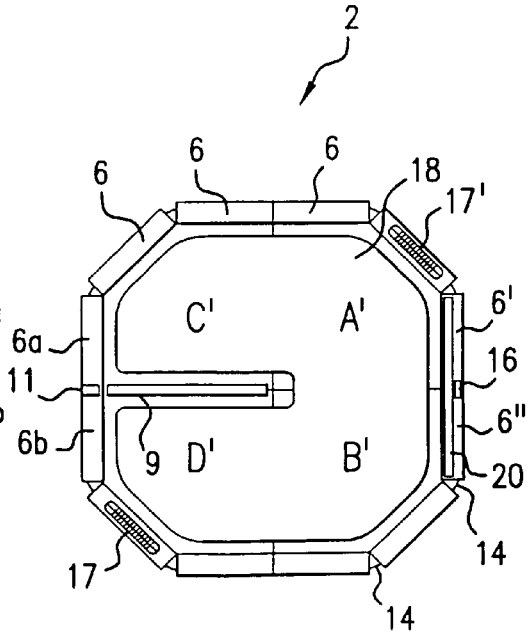
FIG. 2B is an orthogonal bottom view of the first embodiment with the edges folded into the plane of the base portion.
Figure 3A:
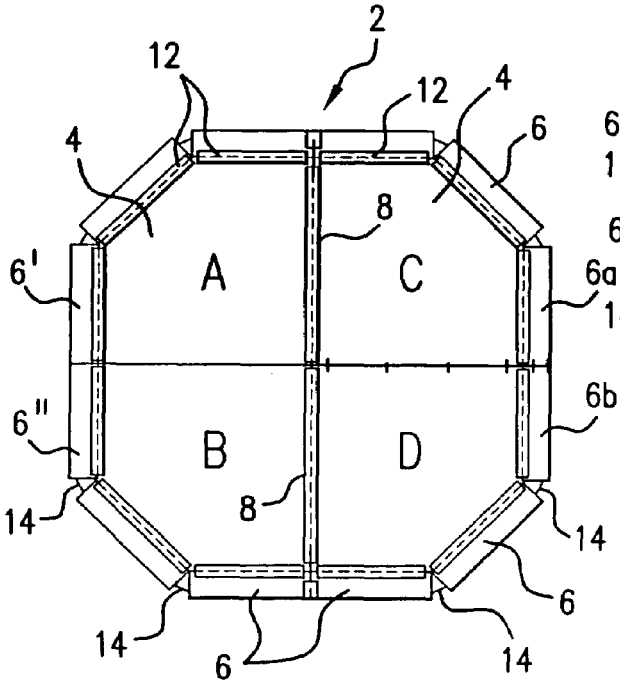
FIG. 3A is an orthogonal top view of the first embodiment with the edges folded into the plane of the base portion.
Figure 3B:
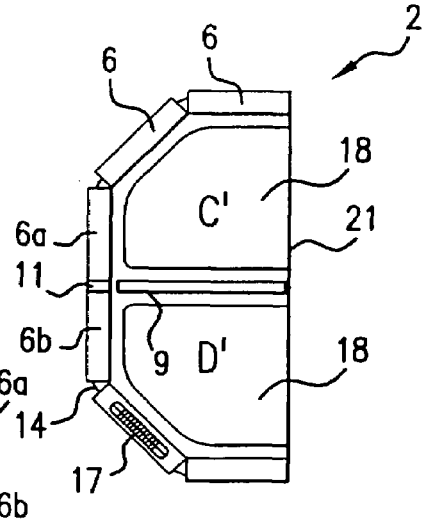
FIG. 3B is an orthogonal bottom view of the first embodiment of the tray in a half-folded position.
Figure 3D:
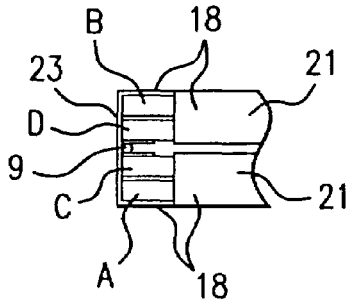
FIG. 3D is an orthogonal side view of the first embodiment of the tray in its fully folded state.
Figure 3C:
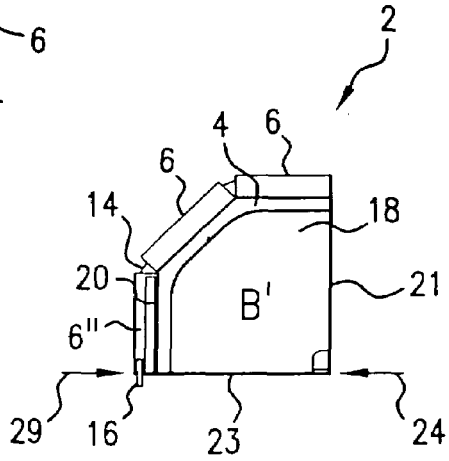
FIG. 3C is an orthogonal bottom view of the first embodiment of the tray in its fully folded state.

FIG. 1A
2—folding tray
4—flat base portion of tray
6—edge portions
6'—one side of latched edge segment
6"—one side of latched edge segment
8—hinge segments on base portion
12—hinges connecting perimeter edges to base portion
16—edge latch FIG. 1B
2—folding tray
6—edge portions FIG. 1C
2—folding tray
4—flat base portion of tray
6—edge portions
8—hinge segments on base portion
11—hinge connecting two edge portions FIG. 2A
2—folding tray
4—flat base portion of tray
6—edge portions
6'—one side of latched edge segment
6"—one side of latched edge segment
6*a*—one side of hinged edge segment (having latch)
6*b*—one side of hinged edge segment (having latch)
8—hinge segments on base portion
10—hinge rivets
12—hinges connecting perimeter edges to base portion
14—cord or fiber FIG. 2B
2—folding tray
4—flat base portion of tray
6—edge portions
6'—one side of latched edge segment
6"—a second side of latched edge segment
6*a*—one side of hinged edge segment (having latch)
6*b*—a second side of hinged edge segment (having latch)
9—hinge segments on base portion
11—hinge connecting two edge portions
14—cord or fiber
16—edge latch
17—tensioning spring
17'—tensioning spring
18—elastomeric sheet
20—elastomeric strip FIG. 3A
2—folding tray
4—flat base portion of tray
6—edge portions
6'—one side of latched edge segment
6"—a second side of latched edge segment
6*a*—one side of hinged edge segment (having latch)
6*b*—a second side of hinged edge segment (having latch)
8—hinge segments on base portion
10—hinge rivets
12—hinges connecting perimeter edges to base portion
14—cord or fiber FIG. 3B
2—folding tray
6—edge portions
6*a*—one side of hinged edge segment (having latch)
6*b*—a second side of hinged edge segment (having latch)
9—hinge segment on base portion
11—hinge connecting the two hinged edge portions
14—cord or fiber
17—tensioning spring
18—elastomeric sheet
21—folded edge of base portion FIG. 3C
2—folding tray
4—flat base portion
6—edge portions
6"—one side of latched edge segment
14—cord or fiber
16—latch connecting two edges
18—elastomeric sheet
20—elastomeric strip
21—folded edge of base portion
23—a second folded edge of base portion
24—view-direction arrow

Figure 3E:
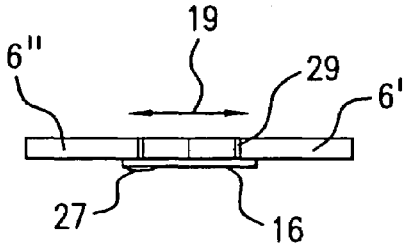
FIG. 3E is an orthogonal side view of the first embodiment of the tray in its unfolded state.
Figure 3F:
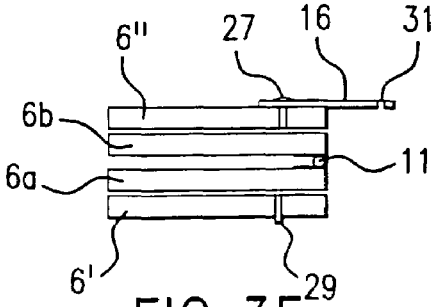
FIG. 3F is an orthogonal side view of the first embodiment of the tray in its fully folded state.
Figure 4A:
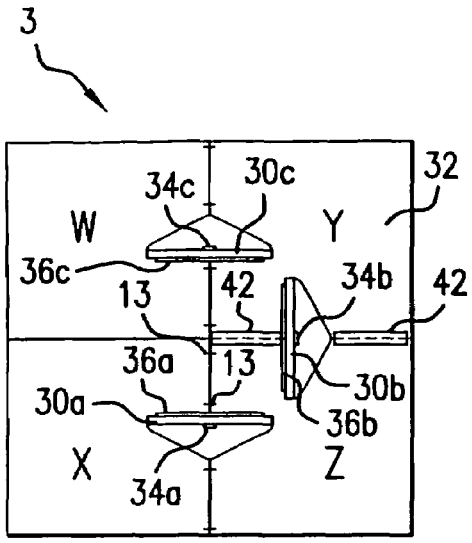
FIG. 4A is an orthogonal top view of a second embodiment of the fully deployed folding tray according to the present invention.
Figure 4C:
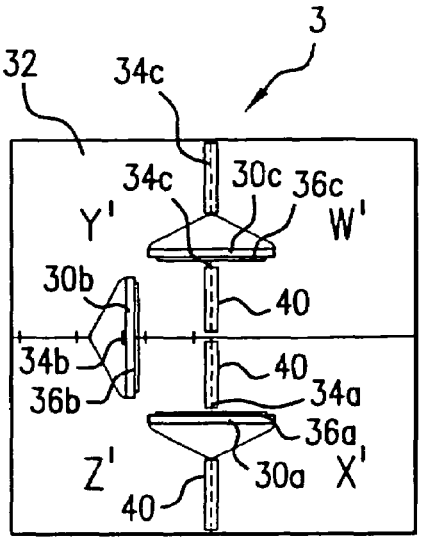
FIG. 4C is an orthogonal bottom view of the second embodiment of the folding tray according to the present invention.
Figure 4B:
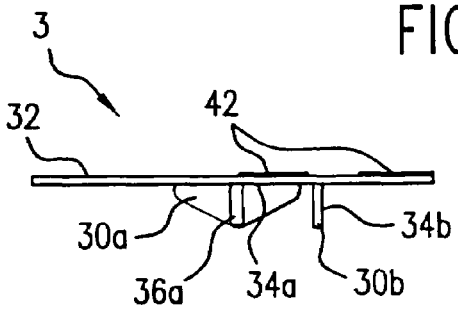
FIG. 4B is an orthogonal side view of the second embodiment of the folding tray according to the present invention.
Figure 5A:
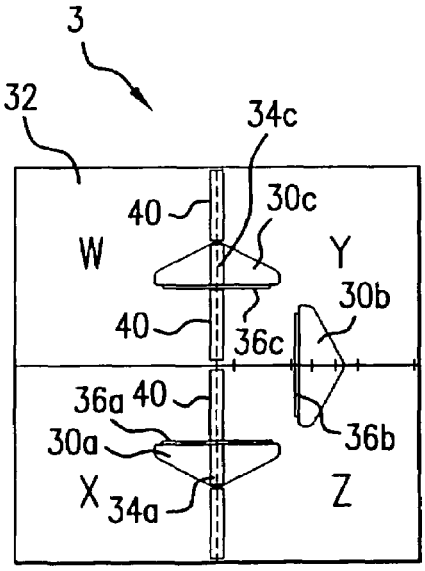
FIG. 5A is an orthogonal top view of the second embodiment with the latching mechanism folded into the plane of the base portion.
Figure 5B:
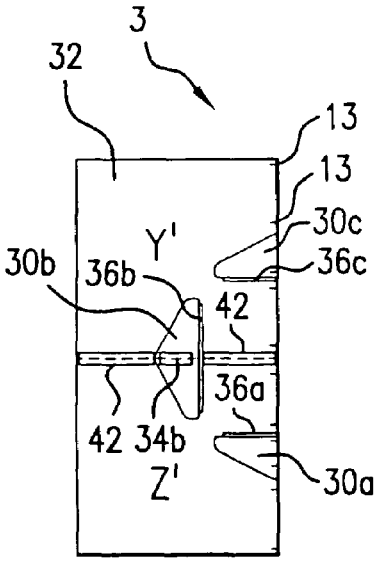
FIG. 5B is an orthogonal view of the second embodiment of the tray in its half folded position.
Figure 5C:
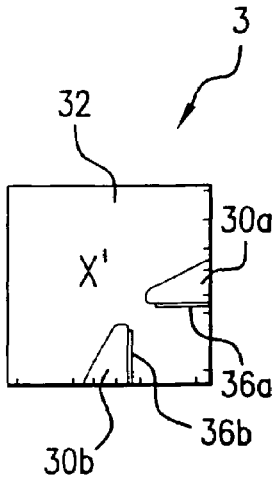
FIG. 5C is an orthogonal view of the second embodiment of the tray in its fully folded state.

29—a second view-direction arrow
FIG. 3D
9—hinge segment on base portion
18—elastomeric sheet
21—folded edge of base portion
23—a second folded edge of base portion
FIG. 3E
6'—one side of latched edge segment
6"—a second side of latched edge segment
16—latch connecting two edges
19—arrow showing direction of tensile stress
27—rivet holding latch
29—latch pin
FIG. 3F
6'—one side of latched edge segment
6"—a second side of latched edge segment
6*a*—one side of hinged edge segment (having latch)
6*b*—a second side of hinged edge segment (having latch)
11—hinge
16—latch connecting two edges
27—rivet holding latch
29—latch pin
31—hole in latch
FIG. 4A
3—folding tray, embodiment #2
13—hinge rivets
30*a, b, c*—flat portions of latching mechanisms
32—flat base portion of tray
34*a, b, c*—hinges in flat portions of latching mechanisms
36*a, b, c*—hinges connecting latching mechanisms to base portion
42—hinge segments on base portion
FIG. 4B
3—folding tray, embodiment #2
30*a, b*—flat portions of latching mechanisms
32—flat base portion of tray
34*a, b*—hinges in flat portions of latching mechanisms
36*a*—hinge connecting latching mechanism to base portion
42—hinge segments on base portion
FIG. 4C
3—folding tray, embodiment #2
30*a, b, c*—flat portions of latching mechanisms
32—flat base portion of tray
34*a, b, c*—hinges in flat portions of latching mechanisms
36*a, b, c*—hinges connecting latching mechanisms to base portion
40—hinge segments on base portion
FIG. 5A
3—folding tray, embodiment #2
30*a, b, c*—flat portions of latching mechanisms
32—flat base portion of tray
34*a, b, c*—hinges in flat portions of latching mechanisms
36*a, b, c*—hinges connecting latching mechanisms to base portion
40—hinge segments on base portion
FIG. 5B
3—folding tray, embodiment #2
13—hinge rivets
30*a, b, c*—flat portions of latching mechanisms
32—flat base portion of tray
34*a, b, c*—hinges in flat portions of latching mechanisms
36*a, b, c*—hinges connecting latching mechanisms to base portion
42—hinge segments on base portion
FIG. 5C
3—folding tray, embodiment #2
30*a, b*—flat portions of latching mechanisms
32—flat base portion of tray
36*a, b*—hinges connecting latching mechanisms to base portion

DETAILED DESCRIPTION OF THE PREFERRED EMBODIMENTS

The preferred embodiment of the present invention is a small hand-carried tray of the sort used by servers to carry drinks and the like in restaurants and cocktail lounges. The tray's special feature is that it can be folded when not being used, and it can be carried by the waiter in its folded position. That is, it can be carried, when folded, in a pocket or in a special holster.

A working model of the first embodiment has been built. It is described in detail below as Embodiment 1. In general, this working model is generally octagonal in shape. It measures about 9 inches in its width and length, and it has a small edge or wall around its perimeter which stands about 1 inch high. The model is made from plastic sheet that is about one-eighth of an inch thick. Brass hinges have been riveted to the plastic components so as to affect the folding feature described below.

The hinge type that was used in the construction of the working model described as Embodiment 1 was of the metal "piano hinge" type made of brass or brass-plated steel. Other hinge types contemplated for use in this folding tray invention include: (1) hinge portions or halves that are manufactured as contiguous with, or integral with, the plastic flat base quadrants and/or the perimeter edge portions, subsequently to be joined by hinge pins of the ordinary type; (2) plastic tape hinges comprised of thin sheets of flexible flat plastic sheet bonded to the respective hinged quadrant portions and/or edge portions; and (3) thin sections of the main tray portions, i.e., such that the entire tray of described here as Embodiment 1 including the quadrants and the perimeter edges, can be made as a single molded plastic unit having thin sections in the hinging locations as described. In other words, regarding the latter possibility, it is conceivable that the folding tray 2 could be manufactured as a single-piece injection-molded piece comprised of the four quadrants of the flat base portion 4 and the eight edge portions 6 such that the thickness of the material in the regions of the hinges would be small and therefore flexible compared to the main body portions. The sheet of elastomeric material 18 on the bottom would then be bonded to the quadrant portions, and provision would be made to install the spring-loaded cords or fibers 14 to pull the edges 6 together in the fully deployed mode.

EMBODIMENT 1

Referring to FIGS. 1A, 1B and 1C, the folding tray 2 according to the present invention is shown in orthogonal top view and side views respectively. FIG. 1C shows the tray 2 in an oblique view. As shown in FIG. 1A, the flat base portion 4 of the octagonal folding tray 2 comprises four quadrants that are labeled A, B, C and D in the figure, a labeling convention that has been chosen as an aid in describing the novel method by which the tray is folded to one quarter of its fully deployed, in-service size. In FIG. 1A, quadrant A of the base portion 4 is joined to the quadrant C by a hinge 8, and the quadrant B is the also joined by a another hinge, also denoted by 8, to the quadrant D. Quadrants C and D are also joined by a hinge. The edge portions 6 of the tray are visible in both the top and side views. In this embodiment, the edge portions 6 comprise a plurality of components, in this embodiment 12, which are connected by hinges 12 (only representative hinges identified in the figure) to the base portion 4. A latch mechanism 16 is evident connecting the two edge portions 6' and 6" in FIG. 1A. As will be seen in this embodiment, two pairs of the edge portions 6 are connected to one another by hinges and also by two spring-loaded and tension-bearing fiber or cord elements described below.

As shown in FIG. 2A, the edges 6 of the tray 2 can be folded downward, at the hinges 12 (only representative hinges identified in the figure), into the same plane as the base portion 4. The edges 6 are folded into the position shown in preparation to folding the entire tray in a method or sequence that is described in detail below. Two separate spring-loaded fibers or cords, both of which are enumerated as 14, are visible in eight places around the perimeter of the flattened edge portions 6. The two fiber or cord segments 14 reside in holes (not shown) inside the edges 6. In FIG. 2B, which shows the bottom side of the tray 2, the four quadrants are labeled A', B', C' and D' to denote the respective bottoms sides of the A, B, C and D quadrants mentioned above. Also shown in FIG. 2B are two springs 17 and 17', to which the two fibers or cords 14 are connected so as to maintain the two fibers or cords in a state of tension and to cause the edges 6 to tend to fold automatically into the fully deployed form shown in FIGS. 1A and 1B. The respective fibers or cords 14 are made of a high-modulus material such as aramid or polyester. An alternative to the use of the aforementioned spring-loaded fibers or cords 14 is contemplated. Specifically, the inventor contemplates using a single, large elastomeric band, equivalent to a large "rubber band," placed around the outer portions of, and bonded to the mid to uppermost portions of, the eight perimeter edge pieces 6.

FIG. 2B also shows a sheet of elastomeric material 18 that is bonded to the four respective quadrants. The elastomeric material 18 serves the purpose of pulling the four quadrants A, B, C and D into the flat or deployed position. The elastomeric sheet 18 is made of urethane or silicone rubber or like compound. A smaller elastomeric strip 20 is bonded to the two edge pieces 6' and 6" respectively, which are also linked by the latch 16 which, when the tray is fully deployed, i.e., unfolded, maintains the two quadrants A and B that are not connected by a hinge, in flat relationship to one another. The latch 16 is described in more detail below.

The hinge 9, linking quadrants C' and D' (the back sides, respectively, of quadrants C and D), is shown, as is also the short hinge segment 11 that links the two edge portions 6*a* and 6*b*.

The folding sequence is illustrated in FIGS. 3A, 3B and 3C. FIG. 3A is shown as the initial part of the folding sequence, in which all of the 12 edge pieces 6 are oriented into the same plane as the flat base portion 4; this FIG. 3A shows the same view as does FIG. 2B. FIG. 3B shows the bottom sides C' and D' after those quadrants C and D have been folded over top of the unshown quadrants A and B; the folding takes place at the hinge line at which are located the hinge sets 8 shown in FIG. 3A. That is, the base quadrant portions C and D shown in FIG. 3A have been folded over on to the top of the quadrant portions A and B. In FIG. 3B the elastomeric sheet 18 on the bottom is stretched across a gap, which is not shown as such but which comes into being along the edge 21 when the two sets of two quadrants are folded as described.

The quadrant portion D' shown in FIG. 3B is then, in the remaining portion of the folding process, brought upwards and over C', at the hinges 9 and 11, such that bottom side quadrant B' becomes the visible portion shown in FIG. 3C. The elastomeric sheet 18 is stretched across the gaps located at the edges denoted as 21 and 23. The amount of stretching of the elastomeric sheet 18 is approximately twice as much at the edge location denoted as 23 as at the edge location denoted by 21. FIG. 3D shows, in a direction of view that is indicated by the arrow 24 in FIG. 3C, the stretched segments of the elastomeric sheet 18 at the locations that have already been denoted by the numbers 21 and 23. Also shown in FIG. 3D are the quadrants A, B, C and D in relation to one another and in relation to the hinge segment 9 when the tray 2 is completely folded. The elastomeric strip 20 joins the edge portion 6*b* to the unshown edge portion 6*a* which lies directly underneath 6*b*.

Referring to FIGS. 3E and 3F, the operation of the latch 16 becomes apparent. FIG. 3E shows the two edge segments 6' and 6" as viewed from the direction of the arrow 25 shown in FIG. 3A. When the tray 2 is in its fully deployed or unfolded mode as shown in FIGS. 1A and 1B, the two edge segments 6' and 6", which are connected respectively to the quadrants A and B that are otherwise not connected to one another by a hinge segment as are the corresponding quadrant edges, are maintained in spacial relationship to one another by the latch 16, one end of which is connected to the edge 6" at the rivet 27, which the other end engages the pin 29 disposed in the edge segment 6'. The arrow 19 indicates the direction of possible tensile forces that might act to cause a separation of the edges 6' and 6" and the respective quadrants A and B. The latch 16 also acts to resist sheer forces acting between the two edge segments and quadrants, the net effect being maintenance of the flatness of the base portion 4 of the folding tray in its fully unfolded mode. FIG. 3F shows the disposition the latch 16 and the pin 29 when the tray 2 is fully folded.

EMBODIMENT 2

A second embodiment of a folding tray 3, in rectangular form, is shown in top view in FIG. 4A. In this embodiment, there are no vertical edges around the perimeter, as in the first embodiment. A side view of the tray 3 is shown in FIG. 4B, wherein are visible in respective straight-on and side views two latching mechanisms 30*a* and 30*b*. FIG. 4C shows the bottom side of the base portion 32.

When the three latching mechanisms 30*a*, 30*b* and 30*c* are oriented such that the planes of the latching mechanisms are each more or less perpendicular to the plane of the base portion 32, they maintain the base portion, which is comprised of four quadrants labeled W, X, Y and Z, in a rigid and flat deployed position that is fully usable as a tray of the sort used to carry drinks in a restaurant. The three two-part latching mechanisms 30*a*, 30*b* and 30*c* are connected to the base portion 32 by respective hinges 34*a*, 34*b* and 34*c*. Each of the three latching mechanisms also has hinge portions 36*a*, 36*b* (FIGS. 4A and 4C) and 36*c* (FIG. 4C) that bisect the planes of each two-part latching mechanism. The latching mechanisms serve two functions: They maintain the base portion 32 of the tray 3 in the flat state when they are perpendicular to the plane of the base portion, and they work as small legs that hold the tray above any surface on which it sits, thereby also enabling the user of the tray to slide their fingers under the base portion so as to pick it up.

The tray folding sequence is illustrated in FIGS. 5A, 5B and 5C. In FIG. 5A, the latching mechanisms 30*a*, 30*b* and 30*c* are shown in positions where they are oriented in the same plane as the base portion 32; they are rotated into that position by the respective hinges 36*a*, 36*b* and 36*c*. The second set of latch mechanism hinges 34*a*, 34*b* and 34*c*, which join the two parts of each of the latching mechanisms 30*a*, 30*b* and 30*c*, allow the respective latching mechanisms to fold along with the adjoining quadrants to which the latching mechanisms are attached.

Referring to FIG. 5A, the two quadrants Y and Z are rotated about the four linearly aligned hinge sets 34*a*, 34*c* and 40 so as to come into face-to-face contact with the quadrants W and X. FIG. 5B shows the backsides Y' and Z' of the quadrants Y and Z. The visible quadrant Z' in FIG. 5B is then folded along the line defined by the locations of the hinge segments 34*b* and 42 so that Z' and Y' come into face-to-face contact, thereby achieving the completely folded state shown in FIG. 5C.

MATERIALS OF THE PREFERRED EMBODIMENTS

Regarding the materials used in the folding tray embodiments described above, molded, thermal pressed, or machined thermoplastics or thermosetting plastics of the common varieties such as acrylic, ABS and polyester are envisioned for use in the fabrication of the flat base and, if used, the perimeter edges. Fiber-reinforced plastics are also contemplated. The use of metal, cast, stamped or cut, is also envisioned for use in the main body portions of the folding tray.

Regarding the hinges portrayed in the embodiments described above, the hinge type that was used in the construction of the working model described as Embodiment 1 was of the metal "piano hinge" type, such as the sort made of brass or brass-plated steel. Other hinge types contemplated for use in this folding tray invention include, but are not limited to: (1) hinge portions or halves that are manufactured as contiguous with, or integral with, the plastic flat base quadrants and/or the perimeter edge portions, subsequently to be joined by hinge pins of the ordinary type; (2) plastic tape hinges comprised of thin sheets of flexible flat plastic that is bonded to the respective hinged quadrant portions and/or edge portions; (3) thin sections of the main tray portions, i.e., such that the entire tray of described here as Embodiment 1 including the quadrants and the perimeter edges, can be made as a single molded plastic unit having thin sections in the hinging locations as described; and (4) integrally molded-in living hinge, which is a thin webbing between two thick pieces.

While the invention has been described with reference to a preferred embodiment, modifications and alterations will occur to others upon a reading and understanding of this specification which is intended to include all such modifications and alterations insofar as they come within the scope of the appended claims or the equivalents thereof. Thus while the invention has been described in combination with specific embodiments, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A collapsible serving tray that is reconfigurable between a first, unfolded or deployed configuration and a second, folded configuration, said serving tray comprising:

first, second, third, and fourth plate segments that are arranged in quadrant fashion, said first plate segment being hingedly connected to said third plate segment by means of a first hinge member, said second plate segment being hingedly connected to said fourth plate segment by means of a second hinge member, and said third plate segment being hingedly connected to said fourth plate segment by means of a third hinge member;

wherein said serving tray is reconfigured from said first configuration to said second configuration by 1) a first folding action, during which first folding action said first and second plate segments pivot about said first hinge member into face-to-face relationship with each other and said second and fourth plate segments pivot about said second hinge member into face-to face relationship with each other, and then 2) a second folding action, during which second folding action said third and fourth plate segments, respectively carrying said first and second plate segments, pivot about said third hinge member into back-to-back relationship with each other;

said serving tray further comprising a first biasing member having fibers spring loaded by tension springs which resists said first folding action and a second biasing member having a flat sheet of elastomeric material bonded to the four plate segments which resists said second folding action, said first and second biasing members functioning to bias said serving tray into said first configuration; and said serving tray further comprising a plurality of edge portions extending from and hingedly connected to said plate segments, said edge portions being biased by said first biasing member toward a converged configuration in which said edge portions are oriented perpendicularly to said plate members and adjacent edge portions are pulled toward each other, said converged configuration also serving to hold said serving tray in said first configuration.

2. The serving tray of claim 1, wherein the fibers spring loaded by tension springs comprises an elastic hoop member which interconnects said edge portions toward said coveraged configuration.

3. The serving tray of claim 1,further comprising a latch mechanism which interconnects adjacent edge portions on said first and second plate members when said serving tray is in said first configuration.

4. The serving tray of claim 1, wherein adjacent edge portions on said third and fourth plate members are hingedly connected to each other.

* * * * *